United States Patent [19]

Bender

[11] Patent Number: 5,024,135

[45] Date of Patent: Jun. 18, 1991

[54] MULTI-STATION CARTRIDGE RELOADING PRESS WITH CONTROLLED POWDER DISPENSING

[75] Inventor: Walter W. Bender, Oroville, Calif.

[73] Assignee: Blount, Inc., Portland, Oreg.

[21] Appl. No.: 451,128

[22] Filed: Dec. 15, 1989

[51] Int. Cl.[5] ..... F42B 33/02

[52] U.S. Cl. ..... 86/31; 86/27

[58] Field of Search ..... 86/23, 25, 27, 28, 29, 86/31, 20.11, 44

[56] References Cited

U.S. PATENT DOCUMENTS

| | | | |
|---|---|---|---|
| 481,127 | 8/1892 | Wagner | 86/31 |
| 3,157,086 | 11/1964 | Bachhuber | 86/31 |
| 3,483,792 | 12/1969 | Williams | 86/27 |
| 3,857,319 | 12/1974 | Welch | 86/31 |
| 4,418,606 | 12/1983 | Lee | 86/23 |

FOREIGN PATENT DOCUMENTS 1508627 1/1968 France .

OTHER PUBLICATIONS

English Translation of French Patent #1.508.627 (REFRA S.N.C.).

*Primary Examiner*—Deborah L. Kyle
*Assistant Examiner*—Stephen Johnson
*Attorney, Agent, or Firm*—Robert L. Harrington

[57] ABSTRACT

A multi-station cartridge reloading press that includes a drive mechanism for a powder measure for reloading spent cartridge cases. A case detecting arm engages a drive rod to operate the powder measure only when a case is present in the powder loading station. A quick change collar mounted on the powder measure is utilized in the initial setup to adjust the operating position of the rod relative to the arm. The collar also establishes a reference position for the powder measure permitting the removal and installation of the powder measure without further adjustment.

5 Claims, 3 Drawing Sheets

MULTI-STATION CARTRIDGE RELOADING PRESS WITH CONTROLLED POWDER DISPENSING

BACKGROUND OF THE INVENTION

1. Field of the Invention

This invention relates to multi-station reloading apparatus utilized to reload spent cartridge cases and in particular it relates to a drive mechanism for a powder measure that engages only when a cartridge case is present in a powder reloading station.

2. Background Information

Multi-station reloading presses are utilized to reload cartridge cases. A single apparatus includes multiple stations that perform the operations of de-priming, sizing, priming, powder dispensing and seating of a bullet on a cartridge case. The presses are most often lever operated and have a moveable ram onto which an indexable shell (cartridge) plate is mounted on a holder. Mounted above the shell plate and holder is a multiple station die plate. The press will typically have five stations with each station tooled to perform a separate operation on a spent cartridge case. A common setup is for station one to deprime and size the cartridge, station two to prime and expand the cartridge case mouth, station three to dispense a powder charge into the case, station four to seat a bullet in the cartridge, and station five to crimp the bullet to the case.

The station that dispenses the powder has a powder measure. In certain configurations a drive mechanism dispenses powder in response to operation of the press. Particularly in the start up and the completion of the cartridge reloading process, i.e. before the first cartridge has been advanced to the powder dispenser station and after the last cartridge has been advanced past that station, it is necessary to deactivate the drive mechanism that causes the powder measure to dispense powder. (A cartridge case is not present at the powder dispensing station in such circumstances.)

Thus in the prior presses, before starting the reloading operation the powder drive mechanism is disconnected. Case #1 is inserted into the shell plate at station one. The press is actuated by manual movement of a lever which moves a ram upward. Case #1 enters a die in the die plate and the first operation (de-prime and size) is performed. The ram is then retracted by movement of the lever in the opposite direction and on the down stroke of the ram, the shell plate is automatically indexed, which advanced the case #1 to station two. The ram continues in its down stroke and a primer is installed in case #1. A case #2 is then inserted into the shell plate holder at station one and the press is cycled again. Case #1 has the case mouth expanded, and case #2 is de-primed and sized. The shell plate is again automatically indexed on the down stroke of the ram and case #1 is advanced to station three (the powder dispensing station) and case #2 is advanced to station two where a primer is installed. A case #3 is inserted into the shell plate at station one. At this point the operator has to remember to re-connect the drive mechanism for the powder measure since the case #1 was now in the powder dispensing station.

The procedure is continued with a new case inserted into station #1 until all of the cases have been reloaded. When the last case to be reloaded is indexed to station four, the operator has to remember to disconnect the mechanism for the powder measure so powder will not be dispensed as the cycles are completed for the remaining cases on the shell plate.

The charging of a case with powder is one of the most important steps in reloading cases. Care must be taken to dispense only one charge of powder. While it seems a simple task for an operator to simply dispense the powder manually, it is easily overlooked, or two charges are dispensed. During the cycling of the press the operator is not only inserting cartridges into station one, but is also visually checking the presence and correct orientation of the primer, loading a bullet into station four and of course cycling the press by operating the hand lever. It is, therefore, very easy to make an error at the powder loading station.

The disadvantage of the drive mechanism of the powder measure being directly connected to the ram motion, is that the powder measure will dispense a charge of powder as the ram reaches the top of the stroke regardless of the presence or absence of a case. Therefore the operator has to remember to disconnect the drive mechanism in those instances where a case is absent from the loading station.

The present invention has a powder measure drive mechanism that will function only when a cartridge case is present in the powder loading station. The present invention is not, however, the first to automatically control powder dispensing. U.S. Pat. No. 4,418,606 issued to Richard J. Lee in 1983 utilizes the cartridge case as a direct link between the ram and drive mechanism. If the cartridge case is not present, the drive mechanism remains inactive. However, the Lee device is complex and inefficient as compared to the device of the present invention summarized below.

SUMMARY

The present invention includes a novel, easily manufactured case detecting and powder measure drive mechanism for controlling the dispensing of powder on a multi-station press. It is simple in construction and readily mountable on multi-station presses.

The preferred embodiment of the present invention has a case detecting arm that is pivotally mounted on the moveable ram assembly. A drive rod is attached to the drive mechanism of the powder measure. The arm pivots to engage the drive rod only when a case is present in the powder dispensing station. When the arm is pivoted to engage the drive rod, movement of the ram assembly to the top of its stroke moves the drive rod to its travel limit causing powder to be dispensed. In the absence of a case in the powder loading station, the arm assumes a pivoted position out of engagement with the drive rod. The ram assembly of the press can then be cycled without dispensing powder.

Refer now to the drawings and the detailed description of the preferred embodiment for a full understanding of the invention.

DESCRIPTION OF THE PREFERRED EMBODIMENT

A multiple station reloading press 10 has all of the functions necessary to reload a spent cartridge case incorporated in one machine in a single setup. Typically the press will be tooled to perform in sequence, at separate stations, the functions of de-priming and sizing, insert primer and expand case mouth, dispense powder, seat bullet, and crimp bullet. Basically the spent case is inserted at station one where an operation is performed and then sequentially indexed to each succeeding station where additional operations are performed. The dies used in the reloading operation are well known to the art and will not be specifically detailed.

One of the principle concerns in the use of a multiple station press to reload cartridge cases is the dispensing of powder into the case. Powder measures have been developed to deliver a precise load of powder at each actuation. It is not, therefore, the powder measure itself that is the concern but rather it is the control of the powder measure during the press cycle.

Figure 1:
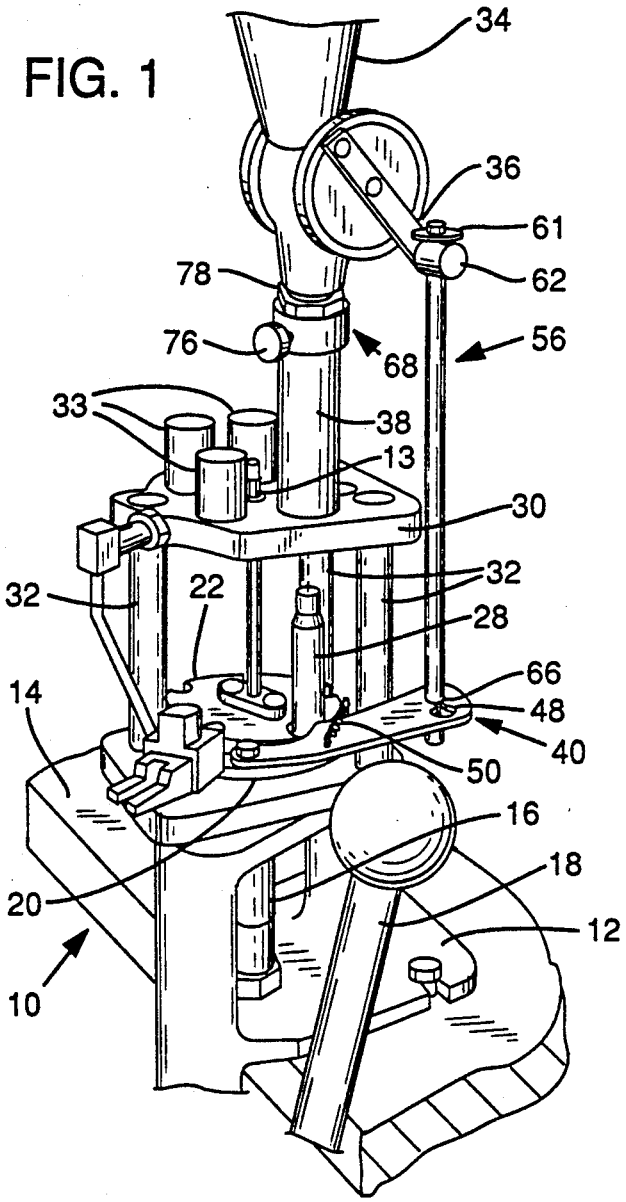
FIG. 1 is a view of a multi-station press showing a drive mechanism and case detector installed.
Figure 8:
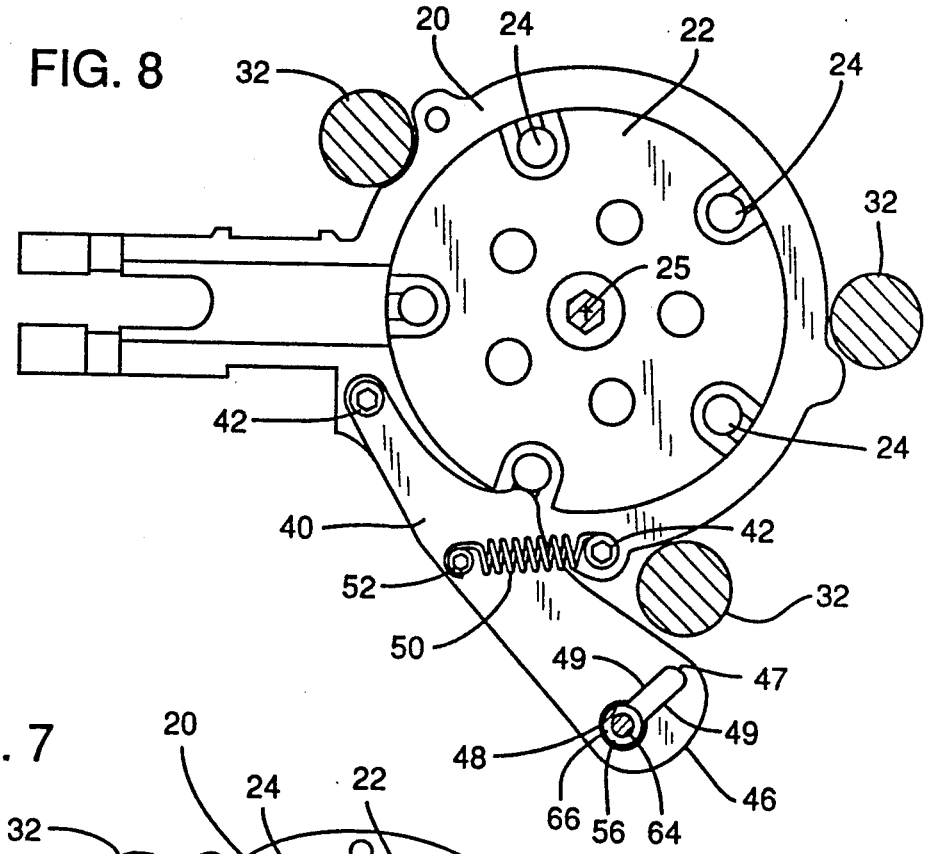
FIG. 8 is similar to FIG. 7 but without a case in the shell plate.
Figure 7:
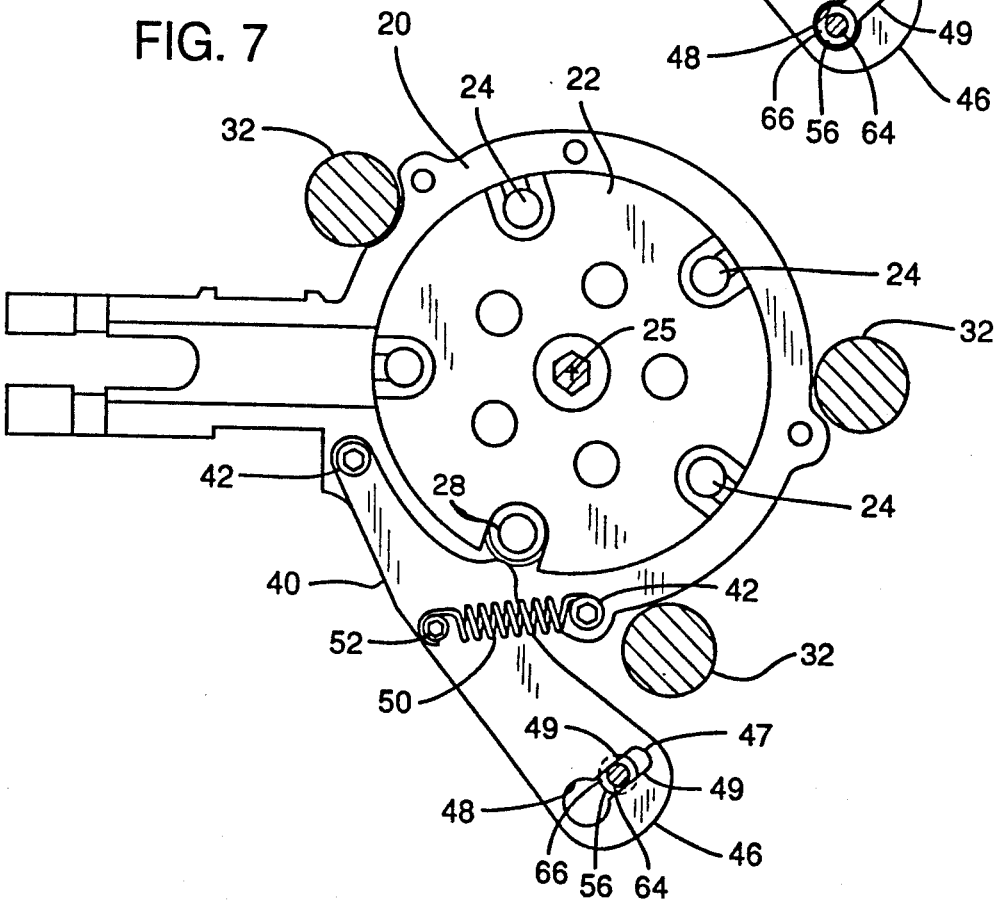
FIG. 7 is a top view of the ram assembly showing a shell plate holder, the cartridge inserted in a shell plate, and the case detecting arm.

As shown in FIG. 1, the press 10 has mounting brackets 12 to rigidly affix it to a work bench 14 or other suitable support. The press 10 has a moveable ram, or reciprocating means, 16 that is actuated by the operating handle 18 as is typical of reloading presses. The moveable ram 16 has an upper travel limit and a lower travel limit. Mounted on the end of the ram 16 is a shell plate holder 20. An indexing shell plate 22 is rotatably mounted to the shell plate holder 20 and a detent mechanism (not shown) is provided to accurately position the shell plate 22 as it is indexed. The shell plate is indexed by an indexing mechanism generally indicated by the numeral 13. Generally, a different shell plate is provided for each caliber to be reloaded. The ram 16 with the holder 20 and shell plate 22 is sometimes hereafter referred to as a ram assembly. As seen in FIGS. 7 and 8, the shell plate 22 has multiple cartridge case holding slots 24. The slots 24 each hold a cartridge case 28 in position as the reloading operations occur and as the shell plate 22 is indexed.

Referring back to FIG. 1, mounted above the shell plate 22 is a multi-station die plate 30 that is supported in a fixed position on support rods 32. The reloading dies 33 and the powder measure 34 are installed on the die plate 30.

Figure 6:
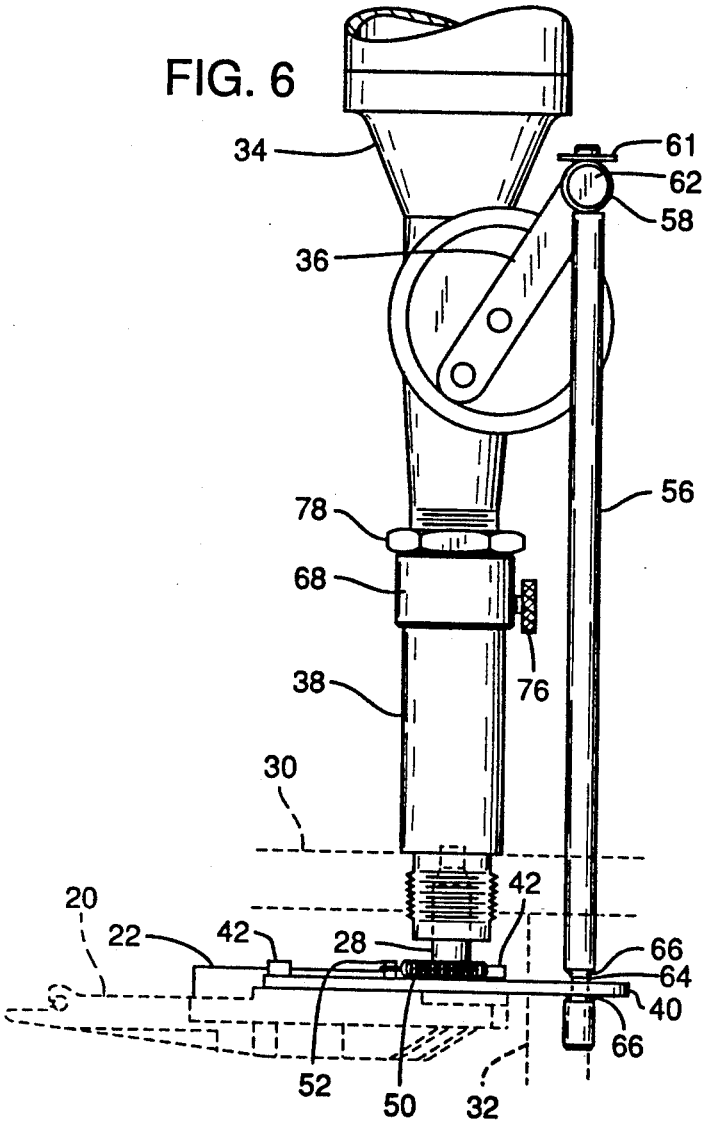
FIG. 6 is a partial view of the press showing the relation of the shell plate of the ram assembly, case detecting arm, drive rod and the powder measure with the ram assembly at the top of the stroke and a case present on the ram assembly.
Figure 5:
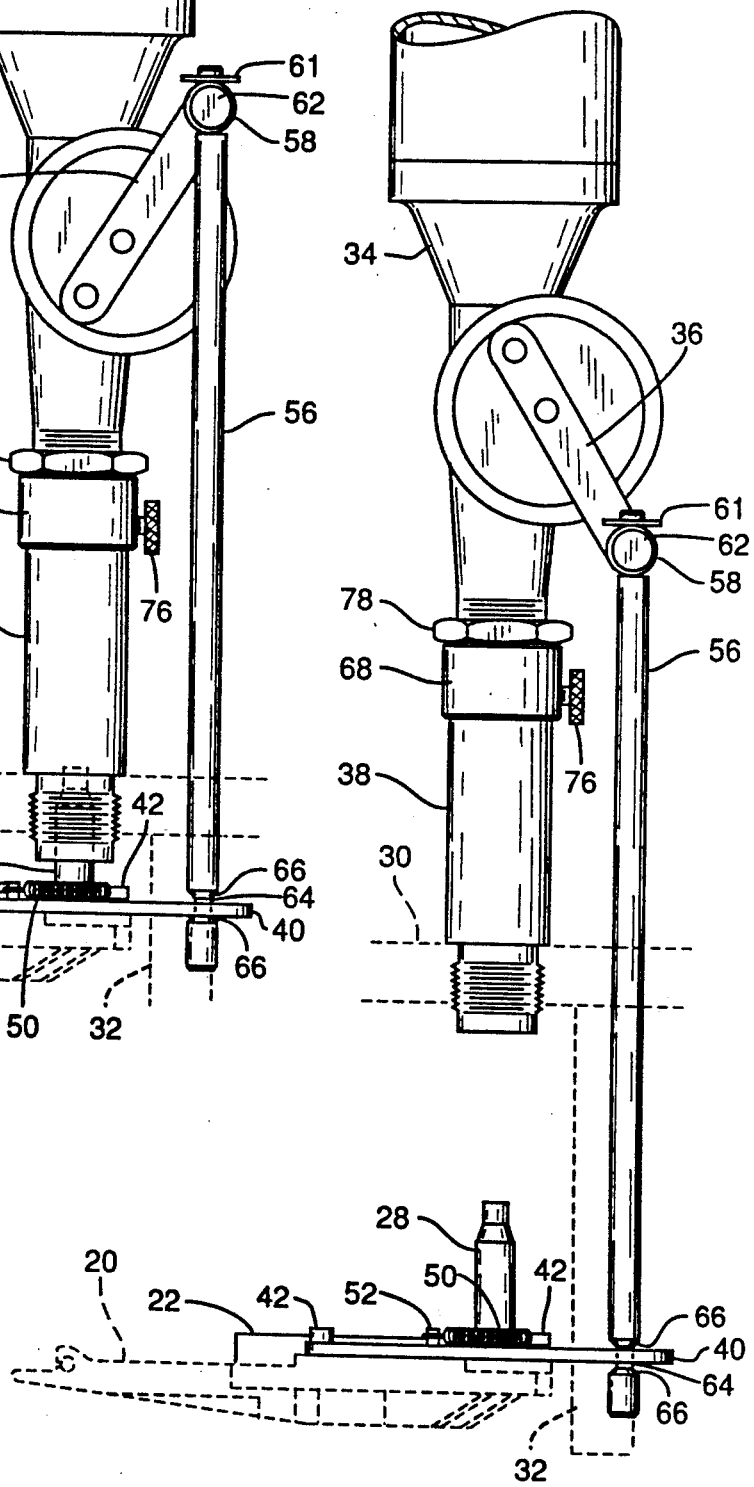
FIG. 5 is a partial view of the press showing the relation of a shell plate of the ram assembly, case detecting arm, drive rod and a powder measure with the ram assembly at the bottom of the stroke.

Referring now to FIGS. 5, 6 and 7, pivotally attached to the shell plate holder 20 is a case detector arm 40. A spring 50 urges the arm 40 toward the shell plate 22 (FIGS. 7 and 8). A drive rod, or element, 56 is attached to a pivot yoke 62 on a powder measure cylinder lever 36 of the powder measure 34 and the rod 56 in cooperation with the case detecting arm 40 function to operate the powder measure 34 when the press 10 is cycled and a case 28 is present in the powder dispensing station. The lever 36 operates the powder measure. The powder measure dispensing mechanism is known and thus not shown in detail.

Figure 2:
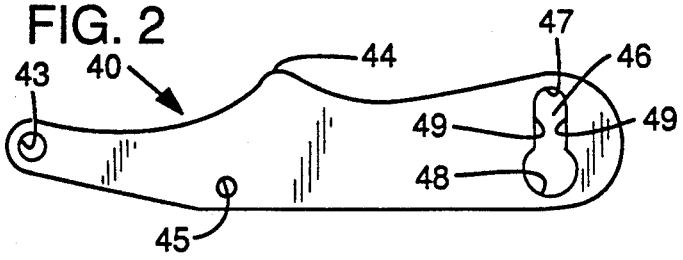
FIG. 2 is a view of a case detecting arm.

The case detector arm 40 is an elongate member and as shown in FIG. 2 it has a bore 43 near one end to facilitate mounting to the shell plate holder 20, a cam lobe 44 (a shaped projection), a bore 45 for attaching the spring 50 and a configured aperture 46. The aperture 46 is provided near the end of the arm 40 opposite the pivoted end. As shown, the aperture 46 is elongate with its length transverse to the length of the arm 40. The aperture 46 is a key shaped slot that has radiused ends. One of the ends is a semi-circle 47 whose radius is less than the radius of the drive rod 56. The sides 49 of the slot are parallel and one end of each parallel side terminates at the point of tangency with the semi-circle 47. The distance between the parallel sides 49 is less than the major diameter of the drive rod 56. The opposite end of the slot is an enlarged circular arc 48, the radius of which is greater than the radius of the drive rod 56. The opposite ends of the parallel sides 49 terminate at the point of intersection of the sides with the circular arc 48.

Figure 3:
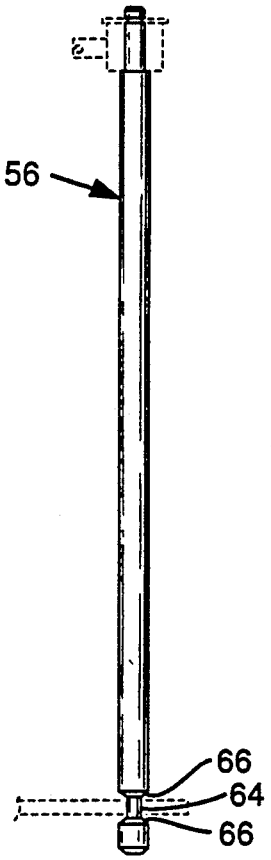
FIG. 3 is a view of a drive rod.

The powder measure drive rod 56 is illustrated in FIG. 3. The drive rod 56 is preferably cylindrical in shape. One end of the rod 56 has a reduced diameter 58 that is insertable into an aperture of the pivot yoke 62 attached to the powder measure lever 36. An annular groove is provided on the reduced diameter 58 for the installation of a spring retaining clip 61 to retain the drive rod 56 in the yoke 62 in a conventional manner as illustrated in FIGS. 5 and 6. Near the opposite end of the drive rod 56, a section of the rod 56 is reduced in diameter thus forming an annular groove 64 with tapered sides 66. The diameter of grooved section 64 is less than the distance between opposed parallel sides 49 of aperture 46.

Refer now to FIGS. 7 and 8 which are top views of the indexing shell plate 22, the shell plate holder 20 and the case detecting arm 40. The shell plate 22 is rotatably mounted on the shell plate holder 20 for rotation relative to plate 20 about axis 25 and it has multiple case-retaining slots 24. As shown in FIGS. 7 and 8, one end of the case detecting arm 40 is pivotally mounted to the shell plate holder 20 by a fastener 42. The pivot axis of the arm 40 is parallel to the rotational axis 25 of the shell plate 22. One end of the spring 50 is fastened to the arm 40 by a fastener 52 and the other end of the spring 50 is attached by a fastener 42 to the shell plate holder 20. The arm 40 is pivotally biased toward the edge of the shell plate 22 by the spring 50 bringing the cam lobe 44 into contact with the edge of the shell plate 22 during the indexing of the shell plate 22. In the absence of a cartridge case 28 (as shown in FIG. 8), the spring 50 biasing the arm 40 against the edge of the shell plate 22 causes the lobe 44 to enter the case retaining slot 24 at the completion of an index. When a case 28 is present in the slot 24 (as shown in FIG. 7), the lobe 44 of the arm 40 will abut against the periphery of the case 28 therefore limiting its pivot.

It is important to position the powder measure 34 at the proper height relative the die plate 30 and length of rod 56 so the powder measure cylinder lever 36 will travel from its lower travel limit to its upper travel limit as shown in FIGS. 5 and 6, respectively, (i.e. through its full cycle) as the ram 16 moves from the bottom of its stroke to the top of its stroke.

Figure 4:
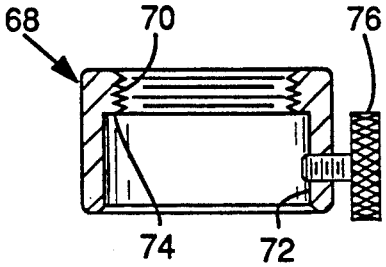
FIG. 4 is a view of a quick change collar.

A quick change collar 68 (FIG. 4) is provided that permits adjustment of the powder measure height relative to the die plate 30, and once set, the powder measure 34 may be removed and reinstalled to the same setting. The collar 68 is a hollow cylinder with one end 70 internally threaded to be installable on the threaded end of the powder measure 34. The opposite end of the collar 68 has an internal bore 72 that terminates at an internal shoulder 74. The bore 72 is sufficiently large so the collar 68 will slide over a mounting adaptor 38 that has been installed in the powder loading station of the die plate 30, and the shoulder 74 of the bore 60 will abut against the top edge of the mounting adaptor 38. A lock screw 76 is provided in the side wall of the collar 68 for locking the collar to the mounting adaptor 38.

To install, a lock nut 78 is first threaded onto the threaded end of the powder measure 34. The threaded end 70 of the collar 68 is then partially threaded onto the threaded end of the powder measure 34. The ram 16 is positioned at the bottom of its stroke and there is not a case 28 in the slot 24 of the shell plate 22. The cam lobe 44 of the case detecting arm 40 is in the slot 24. The assembly is then installed, inserting the end of the drive rod 56 into the arc 48 of the aperture 46 of the arm 40 as the powder measure 34 is installed on the mounting adaptor 38. The collar 68 slides over the adaptor 38 with the shoulder 74 of the collar 68 abutting against the top edge of the adaptor 38. The powder measure 34 is radially positioned so the drive rod 56 is properly aligned with arc section 48 of the aperture 46 in the case detecting arm 40.

The height of the powder measure 34 is adjusted (either lowered or raised) by rotating the collar 68 (clockwise or counterclockwise) while retaining the powder measure 34 in the fixed radial position. The height is adjusted to position the groove 64 of the drive rod 56 in the aperture 46 of the arm 40. After the height has been properly adjusted, the lock nut 78 is screwed down against the collar 68 to lock the collar 68 into position on the powder measure 34. The lock screw 76 is tightened to lock the collar 68 to the mounting adaptor 38. A cartridge case 28 is inserted in the slot 24 at the powder loading station and the grooved portion 64 of rod 56 is received between sides 49. Press 10 is cycled with rod 56 actuating the powder measure to ascertain that the powder measure cylinder lever 36 travels its full cycle (from its lower travel limit to its upper travel limit).

The powder measure 34 may now be removed by simply loosening the lock screw 76, lifting the powder measure 34 off the adaptor 38 and sliding the drive rod 56 through the arc 48 of the aperture 46 in the arm 40. To replace, simply insert the end of the drive rod into the arc 48 of the aperture 46 in the arm 40 as the powder measure 34 is installed on the adaptor 38. Position the powder measure 34 radially to align the drive rod 56 with the aperture 46 and tighten the lock screw 76. The height that was previously set is maintained.

FIG. 5 illustrates the reloading press 10 in the mode where the ram 16 is near the bottom of its stroke. For clarity, most of the press 10 detail has been deleted. In this embodiment, the powder measure 34 is shown mounted on the adaptor 38 in station three of the die plate 30. The case receiving slot 24 of the shell plate 22 that has been indexed to station three, retains a cartridge case 28. It also shows the relationship of the drive rod 56 with the case detecting arm 40. The reduced diameter 58 of the drive rod 56 is installed in the yoke 62 attached to the powder measure cylinder lever 36 and is retained by a spring clip 61. The case detecting arm 40 is pivotally mounted on the shell plate holder 20 by a fastener 42. The arm 40 is pivotally biased toward the shell plate 22 by the spring 50. The drive rod 56 extends downwardly from the cylinder lever 36 (as viewed in the figure) through the aperture 46 of the arm 40 and beyond the bottom of the arm 40 with the annular groove 64 positioned in the aperture 46. With a case 28 in the slot 24 of the shell plate holder 22, the cam lobe 44 of the arm 40 in contact with the periphery of the case 28, pivots the arm 40 to the position shown in FIG. 7. The annular groove 64 of the drive rod 56 is positioned in the aperture 46 of the arm 40 between the parallel sides 49. The distance between the parallel sides 49 of the aperture 46 is less than the major diameter of the drive rod 56. The sides 49 will come into contact with the tapered side 66 of the annular groove 64 as the ram assembly is moved. Note the length of the aperture defined by the parallel sides 49 and terminating at the arc of the semi-circle 47. This is to accommodate the different caliber cases 28 that are reloadable in the press 10.

Refer now to FIG. 6. This figure shows the ram assembly at the top of its stroke. The case 28 has entered the cavity of the adaptor 38, and the arm 40 (which is attached to the shell plate holder 20 of the ram assembly and therefore moved with it) in engagement with the drive rod 56 has moved the rod 56 and the rod 56 connected to the lever 36 has moved the lever 36 to its upper travel limit. At this position, the powder measure 34 charges the case 28 with powder. The ram assembly is then moved to the bottom of the stroke and the arm 40 in engagement with the drive rod 56 moves the powder cylinder lever 36 to its lower travel limit.

Refer now to FIG. 8. There is not a case 28 in the holding slot 24 of the shell plate holder 22. The arm 40 is pivoted by the action of the spring 50 and the cam lobe 44 enters the holding slot 24. The pivoting of the arm 40 places the groove 64 of the rod 56 in the arc 48 of the aperture 46. Movement of the ram assembly now will not impart any motion to the drive rod 56 or the powder measure lever 36. The arc 48 of the aperture 46 has a radius larger than the radius of the drive rod 56. Therefore as the arm 40 is moved with the ram assembly, the arc 48 of the aperture 46 will encircle the drive rod 56 and as the ram assembly is moved, the rod 56 will slide through the arc 48 of the aperture 46. Since there is no motion of the drive rod 56, the powder measure cylinder lever 36 does not move. Therefore, when a case 28 is not present in the powder dispensing station, powder is not dispensed.

It will be apparent to those skilled in the art that modifications and variations may be be made without deviating from the scope of the invention. The invention is therefore to be determined by the appended claims.

What is claimed is:

1. A multiple station reloading press for reloading spend cartridges comprising:

a support bracket;

a shell plate adapted to receive a plurality of cartridge cases to be reloaded;

indexing means for moving the shell plate and thereby indexing the cartridge cases to specified reloading positions, one of said positions being a powder loading station;

a die plate mounted on said support bracket above said shell plate, reloading members mounted in the die plate at the reloading positions, one of said reloading members being a lever actuated powder dispenser for dispensing powder into a cartridge case positioned at the powder loading station;

reciprocating means for producing relative reciprocal motion between the shell plate and die plate to move them toward and away from each other, and the improvement that comprises;

a drive element connected to a lever of the powder dispenser;

connecting means for selectively interconnecting said drive element to said reciprocating means to actuate the lever and thereby dispensing powder in response to operation of the reciprocating means, said connecting means including a portion moveable between positions projected into and out of a cartridge case space to be occupied by a cartridge case positioned at the powder loading station;

said connecting means disconnecting the drive element from the reciprocating means when said portion is projected into said cartridge case space when empty, and connecting said drive element to the reciprocating means when a cartridge case occupies said cartridge case space.

2. A multiple station reloading press as defined in claim 1 wherein;

the connecting means includes an arm pivotally mounted at one end for moving into and out of the cartridge case space, said arm having a projecting lobe and biasing means for urging the lobe into the cartridge case space positioned at the powder loading station, said lobe being forced out of said space upon positioning of a cartridge case at the powder loading station, said arm having a configured aperture designed to engage the drive element, said arm being laterally moveable relative to the drive element to a position wherein the configured aperture of the arm engages the drive element to reciprocate the drive element upon operation of the reciprocating means when said cartridge case occupies said cartridge case space at said loading station.

3. A multiple station reloading press as defined in claim 2 wherein;

the aperture is key shaped having an arc portion and a restricted portion and the drive element is a cylindrical shaped rod with a portion of its cross section of reduced diameter, said rod positionable in the arc portion of the aperture with the arm biased into the cartridge case space permitting free sliding of the rod through the aperture, and said rod positionable with the reduced diameter in the restricted portion of the aperture when said arm is forced out of said cartridge case space which prevents passage of the larger cylindrical portion whereby the drive rod is forced to reciprocate with the operation of the reciprocating means.

4. A multiple station reloading press as defined in claim 1 wherein;

adjustment means are provided to adjust the powder dispensing lever relative to the drive element.

5. A multiple station reloading press as defined in claim 4 including;

a mounting adapter mounted to the die plate at the powder loading position;

a collar fitted to the adapter, said powder dispenser vertically adjustable relative to the collar; and locking means for locking the collar at an adjusted position whereby the powder dispenser can be dismounted and mounted at a correct height by simply removing the collar with said dispenser attached from the adapter.

* * * * *